United States Patent [19]

Gray

[11] 3,935,057

[45] Jan. 27, 1976

[54] APPARATUS FOR SECURING THE FREE END OF A ROLL OF FIBROUS WEB MATERIAL

[75] Inventor: Robert D. Gray, Wilmington, Del.

[73] Assignee: Scott Paper Company, Philadelphia, Pa.

[22] Filed: Aug. 28, 1974

[21] Appl. No.: 501,146

[52] U.S. Cl. ..... 156/578; 118/59; 118/248; 156/583

[51] Int. Cl.[2] ..... B65C 11/04; B05C 11/00

[58] Field of Search ..... 156/578, 184, 583, 187, 156/444, 6, 390; 206/389, 412; 242/1; 118/59, 248, 261

[56] References Cited

UNITED STATES PATENTS

| | | | |
|---|---|---|---|
| 2,622,557 | 12/1952 | Marcantel | 118/248 |
| 3,044,,532 | 7/1962 | Ghisoni | 156/361 |
| 3,134,980 | 5/1964 | Alexander | 156/307 |
| 3,806,388 | 4/1974 | Contini | 156/184 |

*Primary Examiner*—Douglas J. Drummond
*Attorney, Agent, or Firm*—R. Duke Vickrey; William J. Foley

[57] ABSTRACT

Disclosed is an apparatus for securing the free end of a roll of fibrous web material to the body of the roll while the roll is uninterruptedly conveyed through the apparatus. The apparatus is particularly useful for securing the free end of fibrous web material which has a pattern-disposition of blockable bonding material disposed in the web for bonding fibers together. The apparatus, in its preferred embodiment, includes a knurled wheel mounted for rotation in a reservoir of moisture for applying moisture to the outside surface of the free end while held against the roll, electrically heated bars positioned for applying heat to the moistened portion of the free end, pressure members positioned opposite the heated bars for passage of the roll between the pressure members and the heated bars to cause pressure to be applied to the roll by the heated bars, a pair of stationarily positioned, spaced-apart elongated guide members for guiding the roll in its axial direction past and into operative contact with the knurled wheel, with the heated bars, and with the pressure members, and paddle means for moving the roll uninterruptedly through the apparatus.

7 Claims, 3 Drawing Figures

APPARATUS FOR SECURING THE FREE END OF A ROLL OF FIBROUS WEB MATERIAL

BACKGROUND OF THE INVENTION

1. Field of the Invention

The invention relates to apparatus for securing the free end of a roll of fibrous web material to the body of the roll. The invention is particularly applicable to a fibrous web material which has pattern-disposed blockable bonding material in the web to bond fibers of the web together.

2. Description of the Prior Art

One problem facing the manufacturers of rolled products such as paper and other fibrous webs is securing the free end of the roll to the body of the roll. Examples of prior art apparatus for securing the free end of a roll are disclosed in the following patents. U.S. Pat. No. 3,044,532 to Ghisoni discloses an apparatus in which a roll, while being transported on a conveyor, is unwound slightly to expose the free end for application of glue in a strip to the underside of the free end, and then the roll is rewound to adhere the free end to the roll. U.S. Pat. No. 3,134,706 to Alexander discloses an apparatus wherein the roll, while carried on an intermittently operating conveyor, passes a spray nozzle where moisture is sprayed in a strip on the web. The conveyor is then stopped and a heated pressure bar is pressed against the moistened portion of the web. The heated pressure bar is then raised from the roll, and the conveyor begins movement again and transports the roll out of the apparatus.

U.S. Pat. No. 3,172,612 to Besserdich discloses an apparatus wherein thermoplastic adhesive is applied in a pattern to the underside of the free end of the roll, the free end is rolled against the body of the roll, and a heated, rotating press roll is pressed against the outside of the free end to make the thermoplastic tacky and secure the free end to the Roll. U.S. Pat. No. 3,393,105 to Tellier, Jr., discloses an apparatus which unwinds a portion of the web to expose the underside of the free end for application of glue, and then rewinds the web.

U.S. Pat. No. 3,553,055 to Janik discloses an apparatus in which the roll is carried on a conveyor which stops while glue is applied in a strip to an inner convolution. The free end is then secured by rewinding the web on the roll. British Pat. No. 1,326,043 discloses an apparatus which unwinds the free end, squirts glue on the underside of the free end and rewinds the roll.

U.S. Pat. No. 3,791,907 to Marcalus discloses an apparatus in which a log of rolled paper is intermittently advanced into a saw for cutting into individual rolls. A portion of the log is placed in a manifold just before advancement into the saw. Within the manifold are means for applying a jet of water into several convolutions of the paper to secure the free end to the roll. U.S. Pat. No. 3,806,388 to Contini discloses an apparatus wherein a log of rolled material is conveyed past a glue applicator which applies glue to the roll in a continuous wavy line which crosses back and forth from the free end wrapped about the roll to the portion of the roll beyond the free end.

Disadvantages of these apparatus are, for example, the complicated facilities necessary to unwind a portion of the free end, apply the glue on the inner surface and rewind the web. Another disadvantage is the intermittent operation of the apparatus. It is an object of the present invention to avoid these disadvantages.

SUMMARY OF THE INVENTION

The invention is an apparatus which secures the free end of a roll of fibrous web material while the roll is conveyed through the apparatus without interruption and without partially unwinding and then rewinding the roll. (The roll is preferably in log form, a long roll which is later cut into short consumer rolls.) The apparatus includes moisture-application means for applying moisture to the outside surface of the free end while the free end is wrapped against the roll, heat-application means for applying heat to the moistened free end, pressure-application means for applying pressure to the moistened free end simultaneously with applying heat, guide means for guiding the roll in its axial direction past and into operative contact with the moisture-application means, with the heat-application means and with the pressure-application means, and roll-conveyance means for moving the roll uninterruptedly through the apparatus.

The preferred form of the apparatus is the following. The moisture-application means is provided by a knurled wheel mounted for rotation in the direction of movement of the roll in a position where its periphery contacts the free end of the roll when the roll is moved past the wheel. The moisture-application means also includes a reservoir into which the knurled wheel extends for picking up moisture held in the reservoir. The heat-application means is provided by a plurality of electrically heated long narrow bars positioned with their elongate dimensions in the direction of roll movement. Each bar is individually spring mounted to be urged against the roll. The pressure-application means is provided by a pair of elongate pressure members positioned opposite the heated bars for passage of the roll between the pressure members and the heated bars, the spacing between the members and the bars being maintained by spacing means to be slightly less than the diameter of the roll, whereby pressure is applied to the roll by the heated bars when the roll is passed between the pressure members and the heated bars. The guide means is provided by a pair of stationarily positioned, spaced-apart elongated guide members which are parallel to the pressure members and heated bars and prevent lateral movement of the roll as it is moved through the apparatus. The heated bars are positioned between and beneath the elongated guide bars, and it is the heated bars which support the roll. The roll-conveyance means is provided by a paddle for engaging the trailing end of the roll sliding between the guide members and paddle drive means for continuously moving the paddles in a direction parallel to the elongate dimension of the guide members.

DESCRIPTION OF THE PREFERRED EMBODIMENTS

Figure 1:
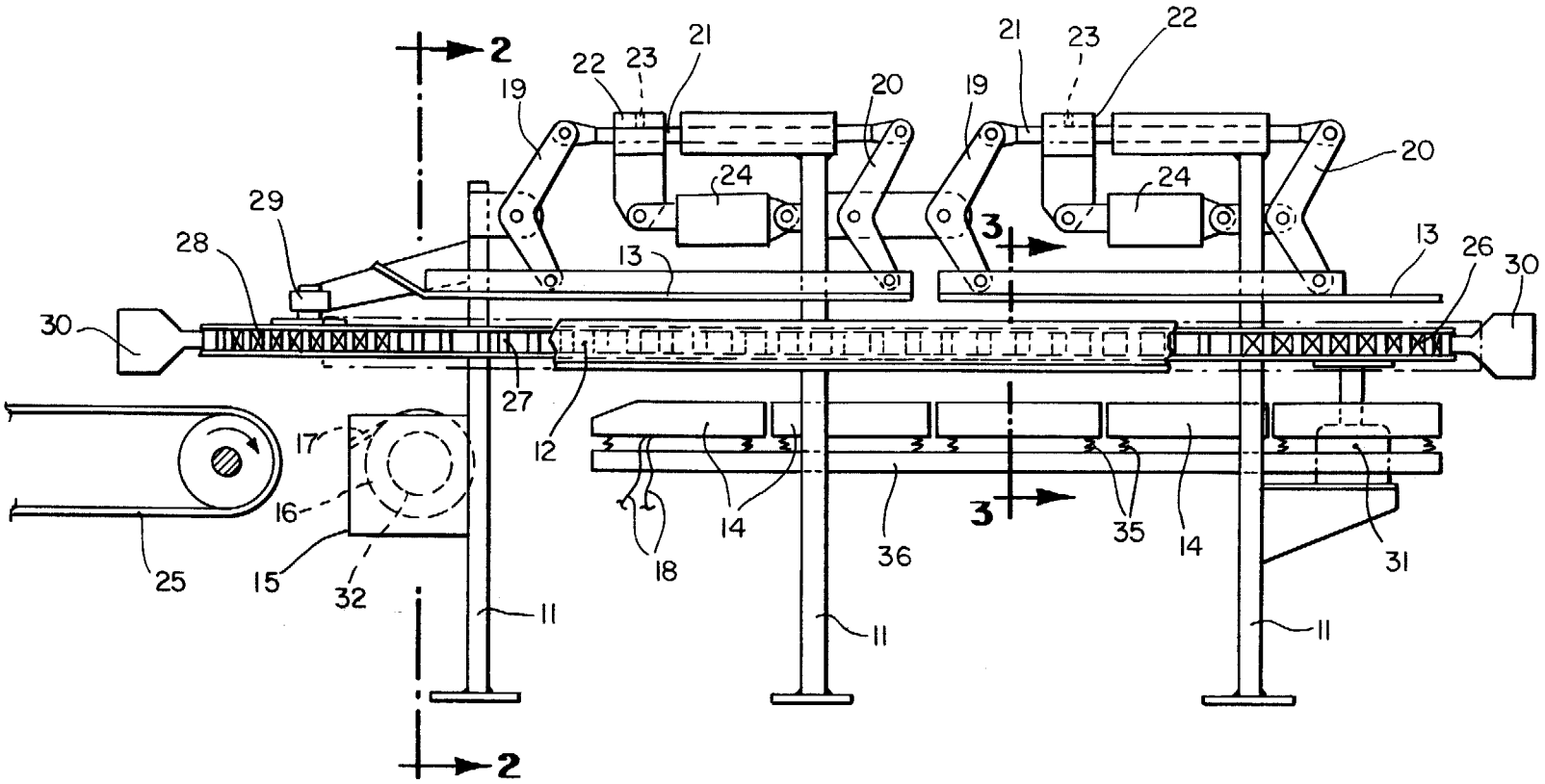
FIG. 1 is a side elevation view schematically illustrating the apparatus of the invention.
Figure 2:
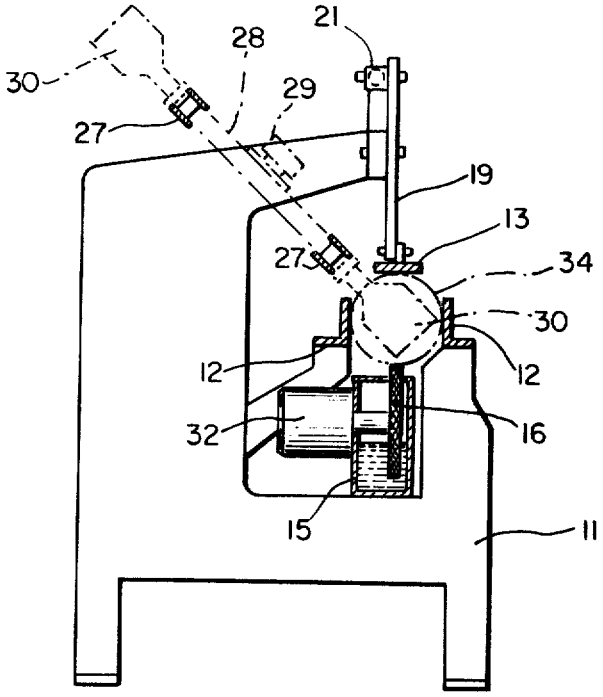
FIG. 2 is a sectional view taken along line 2—2 in FIG. 1.
Figure 3:
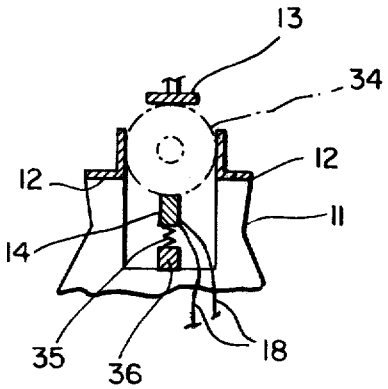
FIG. 3 is a sectional view with portions removed taken along line 3—3 of FIG. 1.

A roll (or log) of fibrous web material is transported to the apparatus by horizontal conveyor 25 (FIG. 1). Conveyor 25 is positioned to pass the roll into the apparatus between elongated guide members 12, which guide the roll through the apparatus in a manner to be described. The guide members 12 are mounted to the apparatus frame 11 in a manner which extends their elongate dimension in the direction of roll movement, and they each have a wide surface disposed vertically to hold the roll against lateral movement as it moves through the apparatus. As the trailing end of the roll approaches the end of conveyor 25, conveyor mounted paddle 30 operably engages the trailing end of the roll (see FIG. 2) and pushes the roll uninterruptedly through the apparatus. After being moved through the apparatus, the roll 34 of web material (shown in broken line in FIGS. 2 and 3) is taken away by conventional means (not shown), such as a conveyor similar to conveyor 25.

While being conveyed through the apparatus, the roll 34 of web material is first brought into operable engagement with moisture-application means, which are provided by knurled wheel 16, reservoir 15, doctor blade 17, and driving motor 32. Knurled wheel 16 is positioned so that its periphery lightly contacts the bottom of roll 34 when roll 34 is moved into the apparatus. Knurled wheel 16 rotates through reservoir 15, containing moisture, which is preferably water. Drive motor 32 rotates wheel 16 to pick up a desired quantity of water and transport it to roll 34. Doctor blade 17, which is preferably made of any flexible material such as rubber, is used to meter and remove excess moisture from knurled wheel 16. Although knurled wheel 16 could be rotated through frictional contact with the moving roll 34, it is preferable to drive knurled wheel 16 with drive motor 32 in the direction of roll movement. It has been found particularly preferable to drive knurled wheel 16 at a peripheral speed slightly faster than the movement of roll 34.

After application of moisture to the roll 34, the roll is conveyed between heated bars 14 and pressure plates 13, both of which are mounted to the apparatus frame 11. Heated bars 14 are long, narrow bars preferably heated by electrical means through leads 18 (shown for only one bar) and are employed to heat the moistened area of roll 34. Heated bars 14 are positioned between and beneath guide members 12 and are mounted to frame bar 36 through springs 35 to permit each one to move up or down independently to accomodate variations in diameter along the length of the roll. The elongate dimension of heated bars 14 is parallel to the elongate dimensions of the guide members 12. The number of heated bars 14 employed can be from one to any reasonable number, the larger number providing more adjustability to roll diameter variances.

Pressure plates 13 are each mounted for reciprocal movement to their linkage members 19 and 20, which are interconnected by linkage bars 21. Air cylinders 24 are mounted to apparatus frame 11 and to each set of linkage bars 21 through each sleeve 22 and set screw 23. Through conventional application of air pressure to air cylinders 24, pressure plates 13 can be moved up or down to accommodate different size rolls 34. Furthermore, use of air cylinders 24 yieldingly biases the pressure plate 13 and permits application of constant pressure on the roll, because variations in roll 34 diameter are automatically adjusted for through movement of pressure plates 13 either up or down. A single pressure plate 13 could be used but by using a plurality of pressure plates 13, variations in diameter along the length of the roll 34 can be readily accommodated. The amount of force applied to the roll 34 through pressure plates 13 is adjusted to apply a predetermined amount of pressure to the lower portion of the roll by the heated bars 14.

Roll-conveyance means are provided by paddles 30 mounted to endless chain 27, which moves in an obliquely inclined looped path about sprockets 26 and 28. (See FIG. 2, the path is shown in a horizontal plane in FIG. 1 for clarity.) The path is obliquely inclined to permit paddle 30 to move between guide members 12 and pressure plates 13. Sprocket 26 is driven by motor 31, and sprocket 28 is mounted for free rotation in bearings 29. The rolls 34 of web material passed through the apparatus of the invention are generally in log form (before they are cut into short consumer rolls) and may be several feet long, (8 feet long, for example). The apparatus is preferably approximately the length of one log. Therefore, the preferred arrangement is to use two paddles 30, each mounted half way around the loop of the chain 27 from the other, so that succeeding logs can follow immediately behind each log.

Guide members 12 are preferably provided by two stationarily positioned, spaced apart elongate bars which are made of a smooth material, such as steel angles, to permit the rolls 34 to slide easily upon them. They may be coated with a low friction material, such as Teflon. Guide members 12 preferably have their surfaces upon which the rolls 34 slide disposed vertically. They are spaced apart a distance slightly larger than the roll 34 diameter to permit easy movement of the roll 34 over the heated bars 14 without lateral deviation.

The preferred use of the apparatus is for securing the free end of a roll of fibrous web material which has blockable bonding material disposed in a pattern throughout the web for bonding fibers together. The fibers may typically be of wood pulp, or other fibers, and may be formed into a web through conventional papermaking techniques or dry forming techniques. Examples of such webs are paper webs used for products such as bathroom tissues and towels. The bonding materials are such that in the finished product they exhibit a blocking tendency, which is a tendency to cause adjacent convolutions in a roll to stick to each other upon being subjected to pressure, heat, or moisture, either alone or in combination. Examples of bonding materials which exhibit this blocking tendency are acrylates, styrene-butadienes, polybutadienes, acrylonitriles, acrylonitrilebutadienes, polyurethanes, ethylene vinyl acetates, polyvinyl alkyl ethers, polyacetals, polyterpenes, vinyl acrylics, ethylene-vinyl acrylates, polychloroprenes, polychlorohydrins, acrylate-acetate copolymers, plasticized polyvinyl chlorides, plasticized polyvinyl acetates, non-cross linking copolymers of vinyl acetate and acrylic esters, plasticized polyvinyl alcohols, CMC, starch, dextrin, casein and animal glue.

With webs having this type of bonding material, the free end of a roll can be secured to the roll through application of moisture, heat, and pressure. With such application in the right amount, the blocking tendency of the bonding material is increased sufficiently to cause the free end to adhere tightly to the next convolution of the roll without adhering to any convolutions beneath that. Additionally, the free end can be readily pulled free from the web without loss or significant distortion of product.

While the apparatus of the invention is capable of applying moisture, heat, and pressure in a wide range, the following is a guideline to be used, particularly for the types of webs described above. Moisture, preferably water (although a little adhesive could also be added to the water), is preferably applied in an amount of from about 0.0005 to about 0.1 milliliters per linear inch of roll length. Pressure is applied from the heated bar to the web in a range of from about 0.5 psi to about 20 psi. The heated bar is heated to a temperature of from about 250° to 550°F. The length of the heated bar is such that each portion of the moistened web is in contact with the bar from about 0.5 seconds to 20 seconds, the length being dependent upon the speed at which the roll 34 is moved through the apparatus.

The sizes of the various components of the apparatus can be varied somewhat with satisfactory performance. The following sizes have been found satisfactory for use on bathroom tissue rolls of about 4½ inch diameters: knurled wheel — ⅛ inch wide; heated bars — ½ inch wide; pressure plates — 1½ inches wide; and guide members — 2 inches high.

Preferably, the free end is secured to the roll 34 near the termination of the free end (about 1 inch away), in which case, the roll 34 must be rotated before being passed through the apparatus to align the termination of the free end with the knurled wheel 16 and the heated bar 14. However, the free end can be secured to the roll 34 at any position on the last convolution, in which case a larger portion of the free end will be unsecured.

I claim:

1. Apparatus for securing the free end of a roll of fibrous web material, comprising:

moisture-application means for applying moisture to a selected location on the outside surface of the free end while the free end is against the roll, the moisture-application means comprising a knurled-periphery wheel mounted for rotation in the direction of movement of the roll through the apparatus and in a position where its periphery contacts the periphery of the roll when the roll is moved past, a reservoir into which the wheel extends for picking up moisture held in the reservoir, means for rotating the wheel slightly faster than movement of the roll past the wheel, and doctor means positioned adjacent the wheel for wiping excess moisture from the wheel;

heat-application means for applying heat to the moistened selected location;

pressure-application means for applying pressure to the moistened selected location simultaneously with applying heat;

guide means for guiding the roll in its axial direction past and into operative contact with the moisture-application means, the heat-application means and the pressure-application means; and roll-conveyance means for moving the roll uninterruptedly past the moisture-application means, the heat-application means, and the pressure-application means.

2. Apparatus for securing the free end of a roll of fibrous web material, comprising:

moisture-application means for applying moisture to a selected location on the outside surface of the free end while the free end is against the roll;

heat-application means for applying heat to the moistened selected location, the heat-application means comprising a plurality of electrically heated narrow elongate bars positioned with the elongate dimension in the direction of web movement, and biasing means associated with each bar for urging the bars towards the pressure-application means;

pressure-application means for applying pressure to the moistened selected location simultaneously with applying heat;

guide means for guiding the roll in its axial direction past and into operative contact with the moisture-application means, the heat-application means and the pressure-application means; and roll-conveyance means for moving the roll uninterruptedly past the moisture-application means, the heat-application means, and the pressure-application means.

3. Apparatus according to claim 2, wherein the pressure-application means are provided by at least one elongate pressure member positioned opposite the heated bars for passage of the roll between the pressure member and the heated bars and means for maintaining the spacing between the member and the bars slightly less than the diameter of the roll, whereby pressure is applied to the roll by the heated bars when passing the roll between the pressure member and the heated bars.

4. Apparatus according to claim 3, wherein the member is yieldingly biased towards the heated bars to maintain a constant pressure by the heated bar on the roll.

5. Apparatus according to claim 4, wherein the pressure application means are provided by a plurality of yieldingly biased elongate pressure members.

6. Apparatus according to claim 5, wherein the roll-conveyance means is provided by paddle means engaging the trailing end of the roll moving through the apparatus and paddle drive means for continuously moving the paddles in a direction parallel to the elongate dimension of the guide means.

7. Apparatus for securing the free end of a roll of fibrous web material, comprising:

moisture-application means for applying moisture to a selected location on the outside surface of the free end while the free end is against the roll;

heat-application means for applying heat to the moistened selected location and for supporting the roll moving through the apparatus;

pressure-application means for applying pressure to the moistened selected location simultaneously with applying heat;

guide means for guiding the roll in its axial direction past and into operative contact with the moisture-application means, the heat-application means and the pressure-application means; and roll-conveyance means for moving the roll uninterruptedly past the moisture-application means, the heat-application means and the pressure-application means, the roll-conveyance means being provided by paddle means engaging the trailing end of the roll moving upon the heat-application means and by paddle drive means for continuously moving the paddles in a direction parallel to the elongate dimension of the guide means.

* * * * *